US010120333B2

(12) United States Patent
Shinagawa

(10) Patent No.: US 10,120,333 B2
(45) Date of Patent: Nov. 6, 2018

(54) IMAGE FORMING APPARATUS HAVING PROCESS CARTRIDGE, CONTROL METHOD THEREFOR, AND STORAGE MEDIUM

(71) Applicant: CANON KABUSHIKI KAISHA, Tokyo (JP)

(72) Inventor: Kazutaka Shinagawa, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/430,762

(22) Filed: Feb. 13, 2017

(65) Prior Publication Data

US 2017/0235268 A1 Aug. 17, 2017

(30) Foreign Application Priority Data

Feb. 17, 2016 (JP) ..... 2016-027775

(51) Int. Cl.
*G03G 15/00* (2006.01)
*G03G 21/18* (2006.01)

(52) U.S. Cl.
CPC ..... *G03G 21/1889* (2013.01); *G03G 15/553* (2013.01)

(58) Field of Classification Search
CPC ... G03G 15/55; G03G 15/553; G03G 21/1889
See application file for complete search history.

(56) References Cited

U.S. PATENT DOCUMENTS 5,699,091 A * 12/1997 Bullock ..... B41J 2/17509 347/19
5,797,061 A * 8/1998 Overall ..... B41J 2/17566 399/24
5,802,420 A * 9/1998 Garr ..... B41J 2/17566 347/19
5,877,692 A * 3/1999 Watanabe ..... G03G 15/553 340/457.4

(Continued)

FOREIGN PATENT DOCUMENTS

JP 2003195699 A 7/2003

OTHER PUBLICATIONS

Machine translation of JP2003195699.*

*Primary Examiner* — David Bolduc
(74) *Attorney, Agent, or Firm* — Rossi, Kimms & McDowell LLP

(57) ABSTRACT

An image forming apparatus which is capable of prompting a user to replace a process cartridge. The process cartridge is comprised of a plurality of components. At least CPU executes instructions to obtain life span information indicating life spans of the components of the process cartridge, determine whether or not the process cartridge is a specific process cartridge for which life span information on a part of the components of the process cartridge is obtained whereas life span information on all the components of the cartridge is not obtained, calculate a life span of the process cartridge, and provide notification of the calculated life span of the process cartridge. When the process cartridge is the specific process cartridge, the life span of the process cartridge is calculated based on only the obtained life span information on the components.

8 Claims, 5 Drawing Sheets

(56) References Cited

U.S. PATENT DOCUMENTS 6,175,375 B1 * 1/2001 Able ..... G03G 15/50 347/132
6,594,451 B2 * 7/2003 Kakeshita ..... G03G 21/1889 399/24
7,667,861 B2 * 2/2010 Umetani ..... G03G 15/50 347/224
2002/0064389 A1 * 5/2002 Semma ..... G03G 15/553 399/12
2003/0091352 A1 * 5/2003 Carling ..... G03G 15/553 399/24
2003/0091353 A1 * 5/2003 Hiroshima ..... G03G 21/1889 399/25
2003/0095278 A1 * 5/2003 Schwartz ..... G03G 15/55 358/1.14
2004/0091274 A1 * 5/2004 Saito ..... G03G 21/1889 399/24
2005/0117918 A1 * 6/2005 Kimura ..... G03G 15/553 399/8
2005/0254838 A1 * 11/2005 Takahashi ..... G03G 15/55 399/12
2006/0062583 A1 * 3/2006 Kikuchi ..... G03G 21/1889 399/24
2007/0122164 A1 * 5/2007 Shiori ..... G03G 15/553 399/8
2007/0122166 A1 * 5/2007 Takahashi ..... C07D 519/00 399/24
2007/0122167 A1 * 5/2007 Sugiyama ..... G03G 15/553 399/24
2007/0201883 A1 * 8/2007 Nakazawa ..... G03G 15/553 399/12
2008/0131146 A1 * 6/2008 Kendall ..... G03G 15/553 399/27
2008/0212984 A1 * 9/2008 Sasaki ..... G03G 15/553 399/24
2009/0309730 A1 * 12/2009 Kothari ..... G03G 21/1657 340/572.1
2010/0202787 A1 * 8/2010 Satonaga ..... G03G 15/55 399/24
2010/0232832 A1 * 9/2010 Matsuda ..... G03G 15/0806 399/119
2011/0293295 A1 * 12/2011 Shinohara ..... G03G 15/553 399/24
2011/0311243 A1 * 12/2011 Kawai ..... G03G 15/5079 399/28
2012/0014700 A1 * 1/2012 Matsumoto ..... G03G 15/556 399/12
2012/0020682 A1 * 1/2012 Ikeda ..... G03G 15/55 399/24
2012/0183310 A1 * 7/2012 Asano ..... G03G 15/5037 399/26
2013/0089351 A1 * 4/2013 Gomi ..... G03G 15/5079 399/75
2014/0079412 A1 * 3/2014 Hymas ..... G03G 15/0863 399/24
2014/0212151 A1 * 7/2014 Oda ..... G03G 15/0863 399/12
2017/0075270 A1 * 3/2017 Saiki ..... G03G 15/50

* cited by examiner

IMAGE FORMING APPARATUS HAVING PROCESS CARTRIDGE, CONTROL METHOD THEREFOR, AND STORAGE MEDIUM

BACKGROUND OF THE INVENTION

Field of the Invention

The present invention relates to an image forming apparatus, a control method therefor, and a storage medium, and in particular to an image forming apparatus having a process cartridge, a control method therefor, and a storage medium.

Description of the Related Art

A process cartridge which is a consumable supply for a printer which is an image forming apparatus is known. The process cartridge is an all-in-one cartridge comprised of a plurality of components, and more specifically, a photosensitive drum, a developing device that develops an image on the photosensitive drum, and a toner supply unit that supplies toner to the developing device. A printer having the process cartridge provides notification of a life span of the process cartridge so as to let a user determine when the process cartridge needs replacing. For example, conventional printers obtain life span information on life spans of the respective components of the process cartridge and calculate a life span of the whole process cartridge based on the obtained life span information on the components. Also, the conventional printers provide notification of the calculation result as the life span of the process cartridge (see, for example, Japanese Laid-Open Patent Publication (Kokai) No. 2003-195699). This enables a user to know when the process cartridge needs replacing without checking life spans of the individual components of the process cartridge.

However, there may be cases where the conventional printers cannot provide notification of the life span of the process cartridge. For example, when the process cartridge is not a predetermined process cartridge, the conventional printers are able to obtain life span information on only of the components of the process cartridge due to system specifications, and in this case, life span information on a component that cannot be obtained is processed as an indefinite value. The conventional printers are configured not to calculate the life span of the whole process cartridge when there is the indefinite value, and hence notification of the life span of the process cartridge is not provided. Therefore, when the process cartridge is not a predetermined process cartridge, the conventional printers cannot prompt a user to replace the process cartridge.

SUMMARY OF THE INVENTION

The present invention provides an image forming apparatus which is capable of prompting a user to replace a cartridge, a control method therefor, and a storage medium.

Accordingly, the present invention provides an image forming apparatus having a cartridge comprised of a plurality of components, comprising a memory device that stores a set of instruction and at least one processor that executes the instructions to obtain life span information indicating life spans of the components of the cartridge, determine whether the cartridge is a specific cartridge on which life span information on some of the components of the cartridge is obtained whereas life span information on all the components of the cartridge is not obtained, calculate a life span of the cartridge, and provide notification of the calculated life span of the cartridge, wherein, when the cartridge is the specific cartridge, the life span of the cartridge is calculated based on only the obtained life span information on some of the components.

According to the present invention, it is possible to prompt a user to replace the cartridge.

Further features of the present invention will become apparent from the following description of exemplary embodiments (with reference to the attached drawings).

DESCRIPTION OF THE EMBODIMENTS

Hereafter, an embodiment of the present invention will be described in detail with reference to the drawings.

Figure 1:
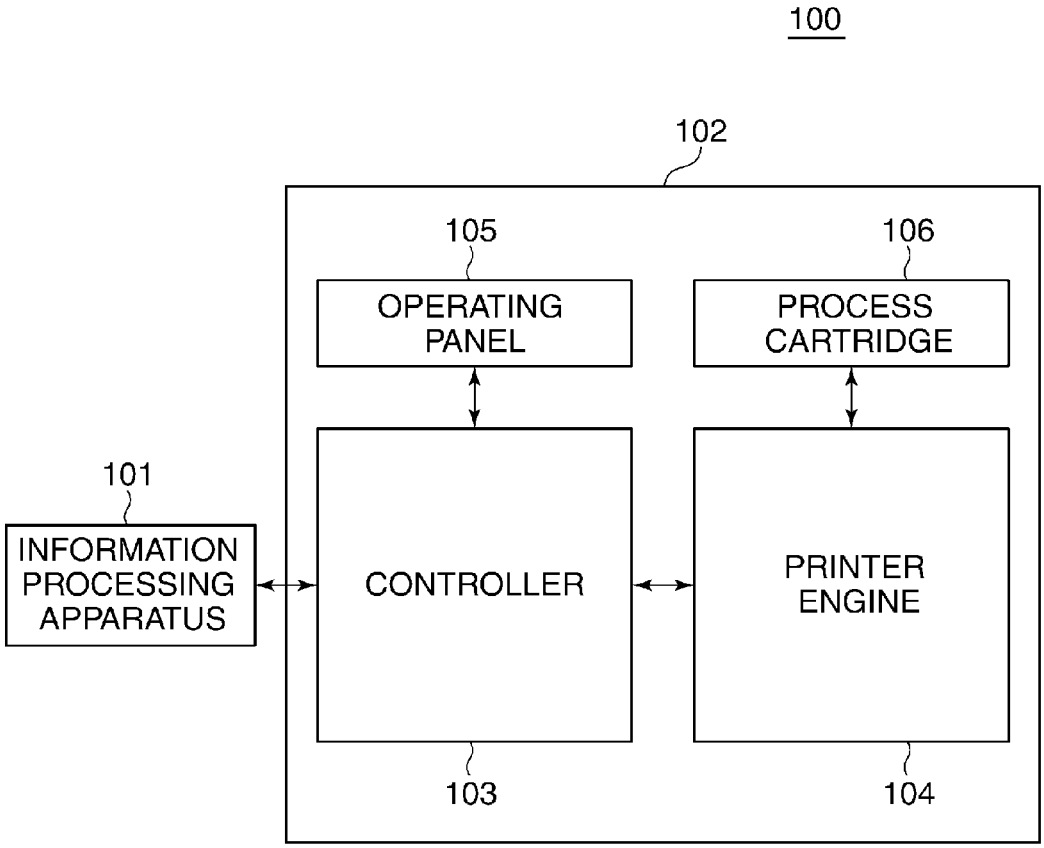
FIG. 1 is a block diagram schematically showing an arrangement of an image forming system including a printer which is an image forming apparatus according to an embodiment of the present invention.

FIG. 1 is a block diagram schematically showing an arrangement of an image forming system 100 including a printer 102 which is an image forming apparatus according to the embodiment of the present invention.

Referring to FIG. 1, the image forming system 100 has an information processing apparatus 101 and the printer 102, and the information processing apparatus 101 and the printer 102 are connected together so that they can carry out data communications with each other. The printer 102 has a controller 103, a printer engine 104, an operating panel 105, and a process cartridge 106. The controller 103 is connected to the printer engine 104 and the operating panel 105, and the process cartridge 106 is connected to the printer engine 104.

The information processing apparatus 101 is a client PC, a DFE (digital front end), or the like, which is able to carry out data communications with the printer 102, generates image data for printing and sends the image data to the printer 102. The printer 102 is able to carry out a copying process, a scanning process, a faxing process, and so forth, and for example, performs printing based on the image data obtained from the information processing apparatus 101. The controller 103 generates bitmap data based on the image data obtained from the information processing apparatus 101 or the like and sends the bitmap data to the printer engine 104. Based on the bitmap data obtained from the controller 103, the printer engine 104 forms an image through, for example, an electrophotographic process using toner and carries out a printing process. The operating panel 105 is a user interface and receives input information input through operation by a user. The operating panel 105 displays a variety of information on the printer 102, for example, a life span of the process cartridge 106. The process cartridge 106 is an all-in-one cartridge which is an integral unit comprised of a plurality of components, and more specifically, a photosensitive drum which is a photosensitive body, a developing device which develops an image on the photosensitive drum, and a toner supply unit that supplies toner to the developing device. It should be noted that in the present embodiment, the process cartridge 106 may be configured to dispense with either the photosensitive drum or the developing device. The process cartridge 106 manages life span information on the components of the process cartridge 106 and sends the life span information on the components of the process cartridge 106 to the controller 103 via the printer engine 104. The process cartridge 106 is removable, and the user checks the life span of the process cartridge 106 displayed on the operating panel 105 and then replaces the process cartridge 106.

Figure 2:
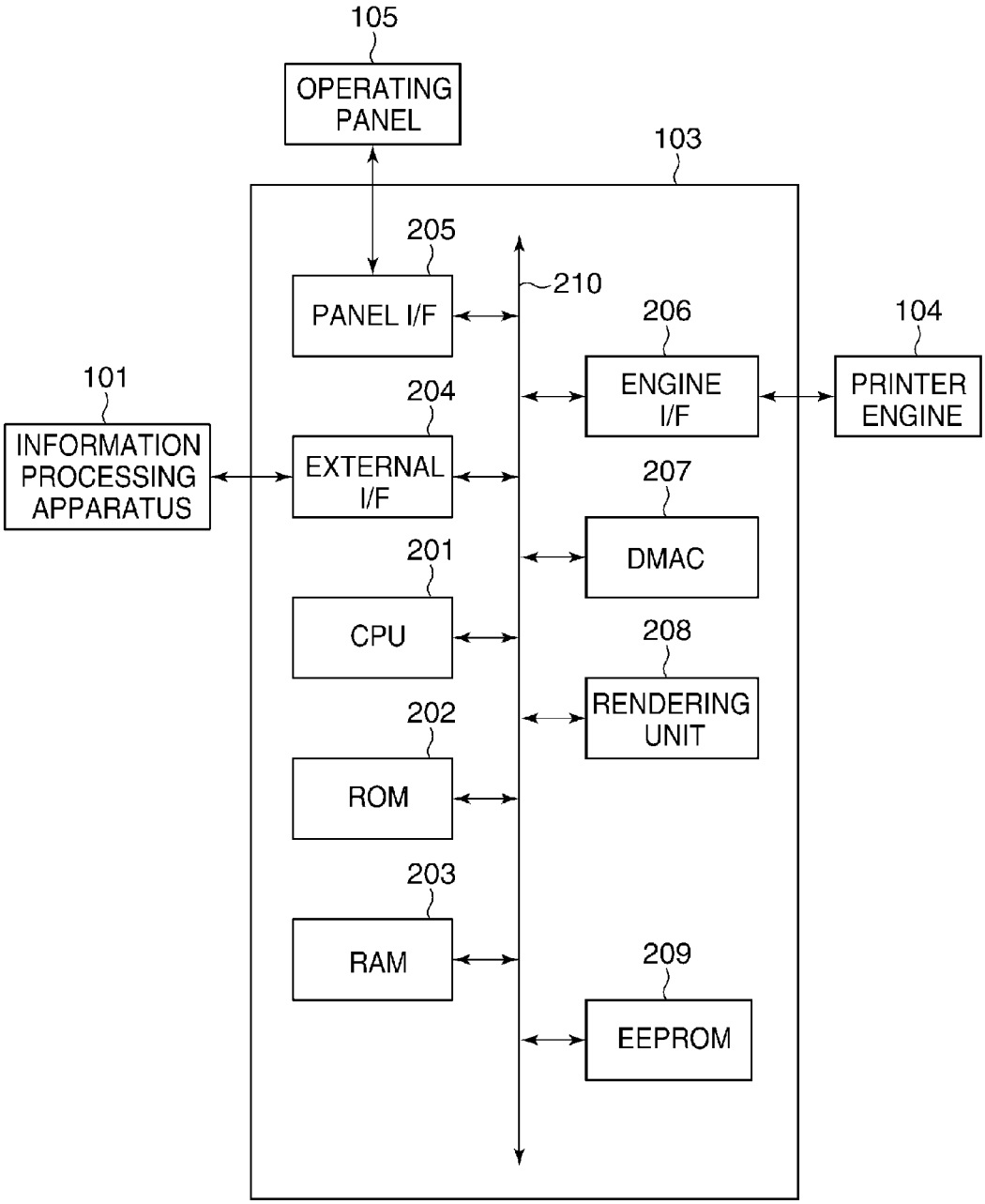
FIG. 2 is a block diagram schematically showing an arrangement of a controller in FIG. 1.

FIG. 2 is a block diagram schematically showing an arrangement of the controller 103 in FIG. 1.

Referring to FIG. 2, the controller 103 has a CPU 201, a ROM 202, a RAM 203, an external I/F 204, a panel I/F 205, an engine I/F 206, a DMAC 207, a rendering unit 208, and an EEPROM 209. The CPU 201, the ROM 202, the RAM 203, the external I/F 204, the panel I/F 205, the engine I/F 206, the DMAC 207, the rendering unit 208, and the EEPROM 209 are connected to one another via a system bus 210.

The CPU 201 expands programs, which are stored in the ROM 202, into the RAM 203 and executes the expanded programs to centrally control the overall operation of the printer 102. The ROM 202 stores programs, which are to be executed by the CPU 201, and data for use in processes. The RAM 203 is used as a work area for the CPU 201 and also used as a temporary storage area for data that is for use in processes carried out by the printer 102. The external I/F 204 carries out data communications with the information processing apparatus 101, the panel I/F 205 carries out data communications with the operating panel 105, and the engine I/F 206 carries out data communications with the printer engine 104. The DMAC 207 writes and reads data into and from the RAM 203 in response to instructions transmitted from the CPU 201. The rendering unit 208 converts image data into bitmap data. The EEPROM 209 stores, for example, setting information on the printer 102.

Figure 3:
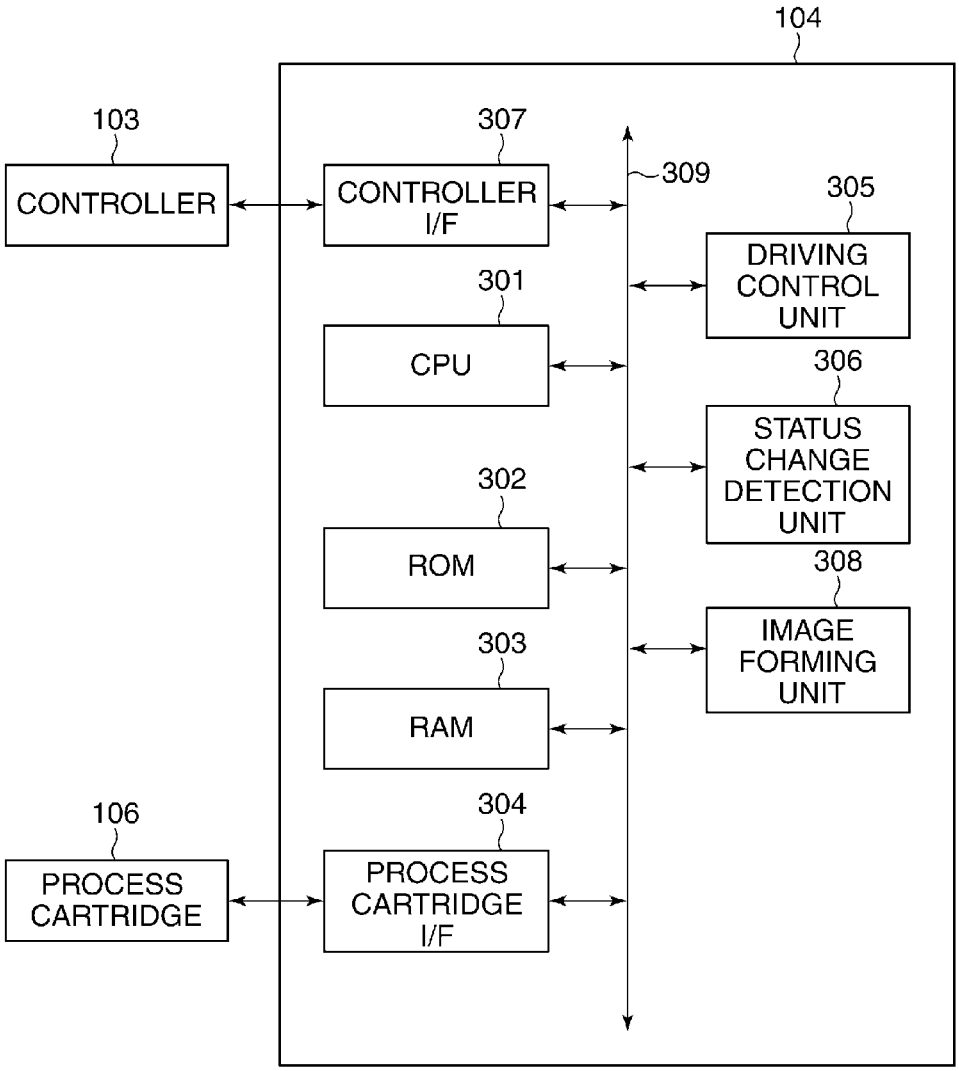
FIG. 3 is a block diagram schematically showing an arrangement of a printer engine in FIG. 1.

FIG. 3 is a block diagram schematically showing an arrangement of the printer engine 104 in FIG. 1.

Referring to FIG. 3, the printer engine 104 has a CPU 301, a ROM 302, a RAM 303, a process cartridge I/F 304, a driving control unit 305, a status change detection unit 306, a controller I/F 307, and an image forming unit 308. The CPU 301, the ROM 302, the RAM 303, the process cartridge I/F 304, the driving control unit 305, the status change detection unit 306, the controller I/F 307, and the image forming unit 308, which are component elements of the printer engine 104, are connected to one another via a system bus 309.

The CPU 301 expands programs, which are stored in the ROM 302, into the RAM 303 and executes the expanded programs to centrally control the component elements connected to the system bus 309. The ROM 302 stores programs, which are to be executed by the CPU 301, and data for use in processes. The RAM 303 is used as a work area for the CPU 301 and also used as a temporary storage area for data that is for use in processes carried out by the printer engine 104. The process cartridge I/F 304 carries out data communications with the process cartridge 106. For example, the process cartridge I/F 304 obtains life span information on the developing device of the process cartridge 106, life span information on the photosensitive drum of the process cartridge 106, and life span information on the toner supply unit of the process cartridge 106, which indicates the remaining amount of toner, from the process cartridge 106. The driving control unit 305 controls operation of motors required for the image forming unit 308 to form an image. The status change detection unit 306 detects a change in status such as a paper jam occurring in the printer 102 or opening of a cover. The controller I/F 307 carries out data communications with the controller 103, and for example, sends life span information on the components of the process cartridge 106 obtained by the process cartridge I/F 304 to the controller 103. The image forming unit 308 forms an image based on bitmap data obtained from the controller 103.

Figure 4:
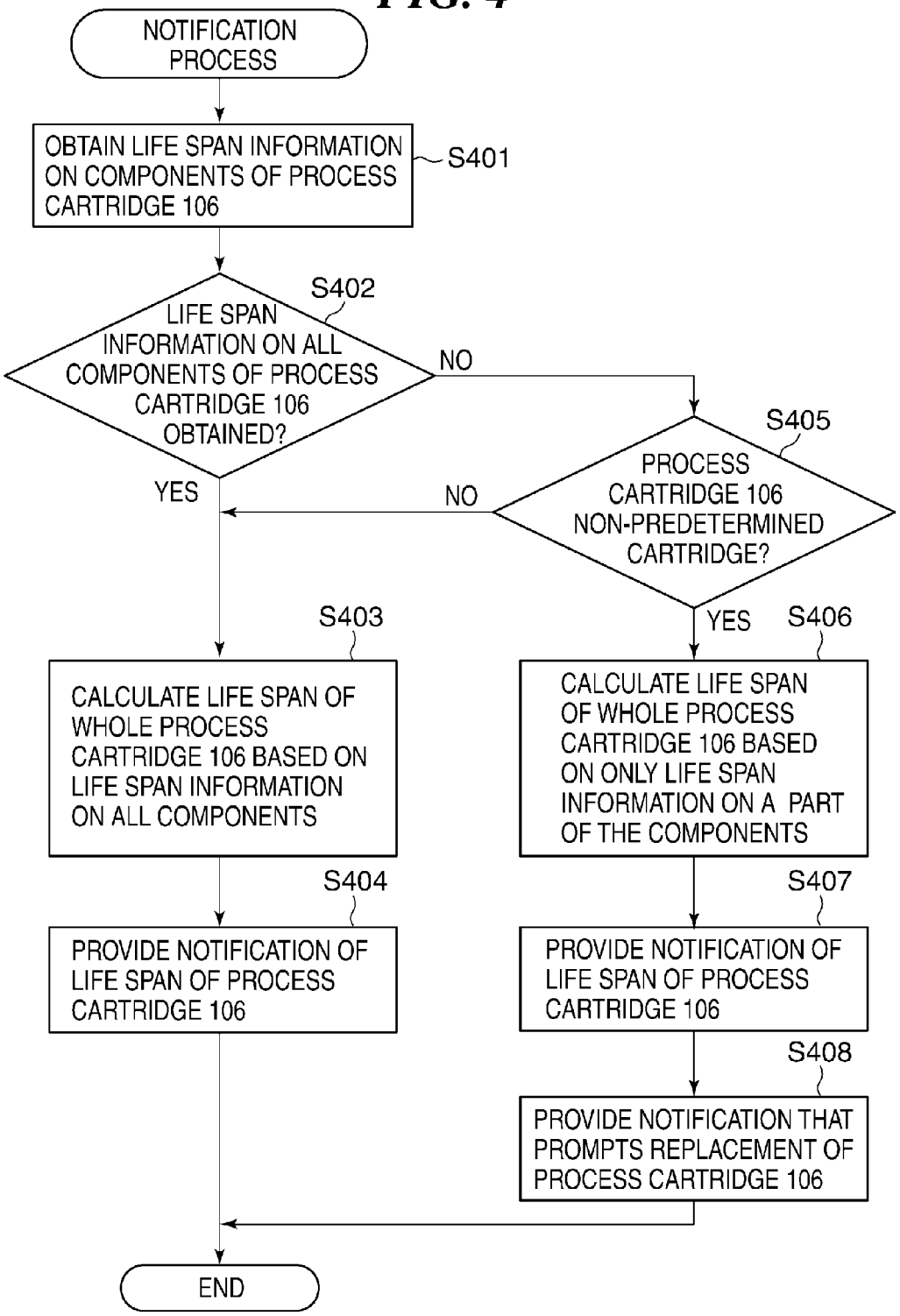
FIG. 4 is a flowchart showing the procedure of a notification process which is carried out by the controller in FIG. 1.

FIG. 4 is a flowchart showing the procedure of a notification process which is carried out by the controller 103 in FIG. 1.

The process in FIG. 4 is carried out by the CPU 201 executing a program stored in the ROM 202.

Referring to FIG. 4, first, the CPU 201 obtains life span information on the components of the process cartridge 106 from the process cartridge 106 via the printer engine 104 (step S401). Next, the CPU 201 determines whether or not life span information on all the components of the process cartridge 106 has been obtained (step S402).

Figure 5A:
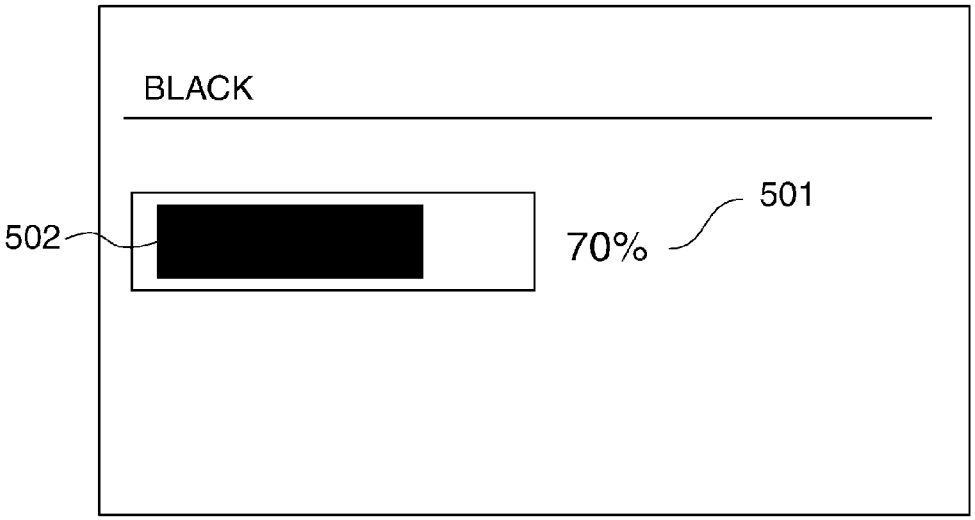
FIGS. 5A and 5B are views showing how a life span of a process cartridge is displayed on an operating panel in FIG. 1.

As a result of the determination in the step S402, when the life span information on all the components of the process cartridge 106 has been obtained, the CPU 201 calculates a life span of the whole process cartridge 106 based on the obtained life span information on all the components of the process cartridge 106 (step S403) (life span calculation unit). The CPU 201 then provides notification of the life span of the process cartridge 106 based on the calculation result (step S404). Specifically, as the life span of the process cartridge 106, for example, as shown in FIG. 5A, the CPU 201 displays, on the operating panel 105, a life span value 501 which expresses the life span of the process cartridge 106 by a percentage, and a bar 502 the length of which changes step by step according to the life span value 501. When the process cartridge 106 is new, a percentage of 100% indicating that the process cartridge 106 is new is displayed as the life span value 501 on the operating panel 105, and the bar 502 is displayed with the maximum length corresponding to the percentage of 100% on the operating panel 105. When the process cartridge 106 is used, the life span value 501 changes to a smaller value according to the status of use, and the bar 502 becomes shorter according to the life value 501. As a result, the user knows when the process cartridge 106 needs replacing without checking life spans of the individual components of the process cartridge 106. After that, the CPU 201 carries out the process in the step S404 and then ends the present process.

As a result of the determination in the step S402, when life span information on any component of the process cartridge 106 has not been obtained, the CPU 201 determines whether or not a specific condition that it is impossible to obtain life span information on all the components of the process cartridge 106 is satisfied. Examples of cases where the specific condition is satisfied include a case where the process cartridge 106 is not a predetermined process cartridge. For example, the predetermined process cartridge is a cartridge that the manufacturer of an image forming apparatus provides or a cartridge that is supposed by the manufacturer to be used for the image forming apparatus. In this case, the printer 102 obtains only life span information on only a part of the components of the process cartridge 106 due to system specifications. On the other hand, examples of cases where the specific condition is not satisfied include a case where the process cartridge 106 is the predetermined process cartridge and the printer 102 has just been started. In this case, the CPU 201 stands by until a certain number of sheets have been printed, and after that, obtains life span information on all the components of the process cartridge 106. To determine whether or not the specific condition is satisfied, the CPU 201 determines whether or not the process cartridge 106 is not the predetermined process cartridge (step S405). In the step S405, for example, when the process cartridge 106 has a memory tag indicative of the predetermined process cartridge, the CPU 201 determines that the process cartridge 106 is the predetermined process cartridge. On the other hand, when the process cartridge 106 does not have the memory tag, the CPU 201 determines that the process cartridge 106 is not the predetermined process cartridge.

Figure 5B:
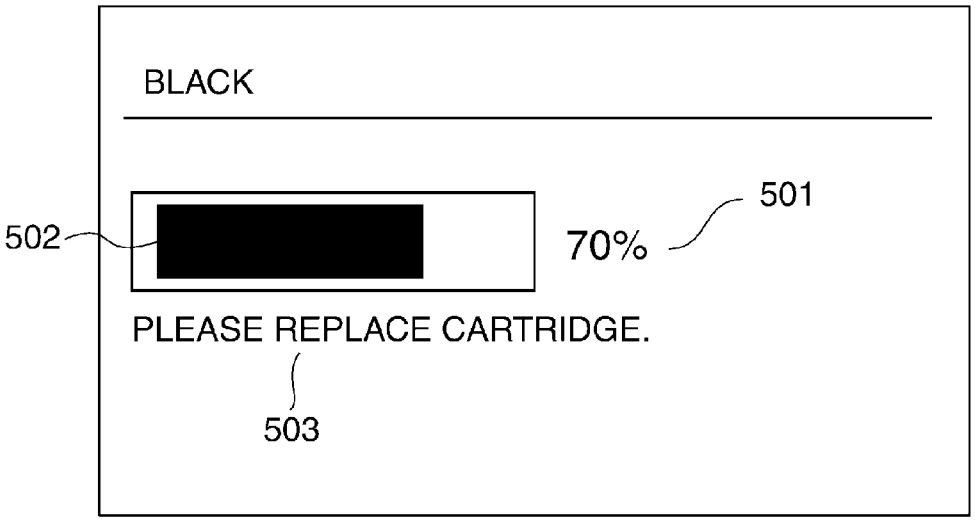

As a result of the determination in the step S405, when the process cartridge 106 is the predetermined process cartridge, the CPU 201 stands by until a certain number of sheets have been printed. After that, the CPU 201 obtains life span information on all the components of the process cartridge 106 and then carries out the processes in the step S403 and the subsequent steps. On the other hand, as a result of the determination in the step S405, when the process cartridge 106 is not the predetermined process cartridge, the CPU 201 calculates the life span of the whole process cartridge 106 based on only the obtained life span information on a part of the components (step S406). Then, the CPU 201 provides notification of the life span of the process cartridge 106 based on the calculation result (step S407) and provides notification that prompts replacement of the process cartridge 106 (step S408). For example, as shown in FIG. 5B, the CPU 201 displays the life span value 501, the bar 502, and a message 503 which prompts replacement of the process cartridge 106, on the operating panel 105. After that, the CPU 201 carries out the process in the step S407 and then ends the process.

According to the process in FIG. 4 described above, when the process cartridge 106 is not the predetermined process cartridge, the life span of the process cartridge 106 is calculated based on only the obtained life span information on a part of the components. Thus, even when the life span information on all the components of the process cartridge 106 has not been obtained, it is possible to calculate the life span of the process cartridge 106 and provide the notification of the life span of the process cartridge 106. As a result, the user is prompted to replace the process cartridge 106.

Moreover, according to the process in FIG. 4 described above, when the process cartridge 106 is not the predetermined process cartridge, the notification that prompts replacement of the process cartridge 106 is provided. Here, when the process cartridge 106 is not the predetermined process cartridge, the life span of the process cartridge 106 is calculated based on only obtained life span information on a part of the components. For this reason, the calculated life span of the process cartridge 106 is unlikely to match an actual life span of the process cartridge 106, and there may be a situation where the actual life span of the process cartridge 106 is shorter than the calculated life span of the process cartridge 106. There is thus a possibility of causing a trouble in which a user cannot obtain printing results with desired timing. To cope with this, in the process in FIG. 4 described above, when the process cartridge 106 is not the predetermined process cartridge, the notification that prompts replacement of the process cartridge 106 is provided. This gives the user a chance of avoiding the trouble which would occur when the actual life span of the process cartridge 106 is shorter than the calculated life span of the process cartridge 106.

Furthermore, in the process in FIG. 4 described above, as the calculated life span of the process cartridge 106, the life span value 501 and the bar 502 are displayed on the operating panel 105, and this enables a user to predict a remaining life span of the process cartridge 106 and reliably prompts the user to replace the process cartridge 106.

In the embodiment described above, when the process cartridge 106 is not the predetermined process cartridge, alternate life span information set in advance may be used as the life span information on components which has not been obtained. The life span of the whole process cartridge 106 may be calculated based on the alternate life span information and the life span information on a part of the components which has already been obtained. A description will now be given of a case where the process cartridge 106 is not the predetermined process cartridge, the life span information on the toner supply unit and the developing device has been obtained, and the life span information on the photosensitive drum has not been obtained. In this case, the CPU 201 calculates the life span of the whole process cartridge 106 based on the life span information on the toner supply unit and the developing device and the alternate life span information used as the life span information on the photosensitive drum.

Moreover, in the embodiment described above, when the process cartridge 106 is not the predetermined process cartridge, estimated life span information on components the life span information on which has not yet been obtained may be calculated based on life span information on components of the process cartridge 106 which has been already been obtained. The life span of the whole process cartridge 106 may be determined based on the estimated life span information and the obtained life span information on a part of the components.

OTHER EMBODIMENTS

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-027775, filed Feb. 17, 2016, which is hereby incorporated by reference herein in its entirety.

What is claimed is:

1. An image forming apparatus having a cartridge comprised of a plurality of components, comprising:

a memory device that stores instructions; and at least one processor that executes the instructions to:

obtain life span information indicating respective life spans of a plurality of components of a first type cartridge, the first type cartridge being a type of cartridge on which life span information on some, but not all, of the components is obtainable;

obtain life span information indicating respective life spans of a plurality of components of a second type cartridge, the second type cartridge being a different type of cartridge than the first type cartridge, and the second type cartridge being a type of cartridge on which life span information on all of the components is obtainable;

determine whether a cartridge in the image forming apparatus is the first type cartridge;

calculate a life span of the cartridge in the image forming apparatus; and provide notification of the calculated life span of the cartridge in the image forming apparatus, wherein, upon a condition that the cartridge in the image forming apparatus is determined to be the first type cartridge on which life span information on some, but not all, of the components is obtainable, the life span of the first type cartridge in the image forming apparatus is calculated based on only the obtained life span information on some of the components.

2. The image forming apparatus according to claim 1, wherein the at least one processor executes the instructions to provide notification that prompts replacement of the cartridge in the image forming apparatus upon the condition that the cartridge in the image forming apparatus is determined to be the first type cartridge.

3. The image forming apparatus according to claim 1, wherein the first type cartridge is a process cartridge comprising a photosensitive body, a developing device that develops an image on the photosensitive body, and a toner supply unit that supplies toner to the developing device.

4. The image forming apparatus according to claim 1, wherein the at least one processor executes the instructions to display the calculated life span of the cartridge in the image forming apparatus.

5. A control method for an image forming apparatus having a cartridge comprised of a plurality of components, comprising:

obtaining life span information indicating respective life spans of a plurality of components of a first type cartridge, the first type cartridge being a type of cartridge on which life span information on some, but not all, of the components is obtainable;

obtaining life span information indicating respective life spans of a plurality of components of a second type cartridge, the second type cartridge being a different type of cartridge than the first type cartridge, and the second type cartridge being a type of cartridge on which life span information on all of the components is obtainable;

determining whether a cartridge in the image forming apparatus is the first type cartridge;

calculating a life span of the cartridge in the image forming apparatus; and providing notification of the calculated life span of the cartridge in the image forming apparatus, wherein in the calculating the life span of the cartridge, in response to the cartridge in the image forming apparatus being determined to be the first type cartridge on which life span information on some, but not all, of the components is obtainable, the life span of the first type cartridge is calculated based on only the obtained life span information on some of the components.

6. A non-transitory computer-readable storage medium storing a program for causing a computer to execute a control method for an image forming apparatus having a cartridge comprised of a plurality of components, the control method for the image forming apparatus comprising:

obtaining life span information indicating respective life spans of a plurality of components of a first type cartridge, the first type cartridge being a type of cartridge on which life span information on some, but not all, of the components is obtainable;

obtaining life span information indicating respective life spans of a plurality of components of a second type cartridge, the second type cartridge being a different type of cartridge than the first type cartridge, and the second type cartridge being a type of cartridge on which life span information on all of the components is obtainable;

determining whether a cartridge in the image forming apparatus is the first type cartridge;

calculating a life span of the cartridge in the image forming apparatus; and providing notification of the calculated life span of the cartridge in the image forming apparatus, wherein in the calculating the life span of the cartridge, in response to the cartridge in the image forming apparatus being determined to be the first type cartridge on which life span information on some, but not all, of the components is obtainable, the life span of the first type cartridge is calculated based on only the obtained life span information on some of the components.

7. The image forming apparatus according to claim 1, wherein upon a condition that the cartridge in the image forming apparatus is determined to be the second type cartridge on which life span information on all of the components is obtainable, the life span of the second type cartridge in the image forming apparatus is calculated based on the obtained life span information on all of the components.

8. The image forming apparatus according to claim 7, wherein the image forming apparatus includes a printer engine and a controller having the at least one processor, and the life span information is obtained from the printer engine.

* * * * *